US008598475B2

(12) United States Patent
Leng et al.

(10) Patent No.: US 8,598,475 B2
(45) Date of Patent: Dec. 3, 2013

(54) ROOF SWITCH ASSEMBLY

(75) Inventors: Peter Leng, Mainz (DE); Janusz Lipka, Warsaw (PL)

(73) Assignee: Delphi Technologies, Inc., Troy, MI (US)

( * ) Notice: Subject to any disclaimer, the term of this patent is extended or adjusted under 35 U.S.C. 154(b) by 134 days.

(21) Appl. No.: 13/379,760

(22) PCT Filed: Jun. 2, 2010

(86) PCT No.: PCT/EP2010/057686

§ 371 (c)(1), (2), (4) Date: Dec. 21, 2011

(87) PCT Pub. No.: WO2010/149475

PCT Pub. Date: Dec. 29, 2010

(65) Prior Publication Data

US 2012/0097507 A1 Apr. 26, 2012

(30) Foreign Application Priority Data

Jun. 25, 2009 (EP) ..... 09163835

(51) Int. Cl.
*H01H 9/00* (2006.01)

(52) U.S. Cl.
USPC ..... 200/4

(58) Field of Classification Search
USPC ..... 200/5 A, 545, 548, 550, 551, 553, 559, 200/329, 330, 17 R, 18, 4
See application file for complete search history.

(56) References Cited

U.S. PATENT DOCUMENTS 6,046,414 A * 4/2000 Hirschfeld ..... 200/18
6,437,259 B1 * 8/2002 Geppert et al. ..... 200/5 R
7,834,286 B2 * 11/2010 Michel et al. ..... 200/339

FOREIGN PATENT DOCUMENTS

DE 39 31 722 12/1990
DE 100 27 484 12/2001

OTHER PUBLICATIONS

International Search Report dated Jul. 22, 2010.

* cited by examiner

*Primary Examiner* — Edwin A. Leon
(74) *Attorney, Agent, or Firm* — Lawrence D. Hazelton

(57) ABSTRACT

A switch assembly for the lift-and-slide roof of a vehicle that includes a housing, an actuating element, a first pair of movable electrical switching contacts, and a second pair of movable electrical switching contacts. Each longitudinal wall of the housing comprises a cross-shaped groove including a cross-shaped guiding track. The cross shaped groove receives a projecting member of the actuating element. The guiding track receives a pressure piece carried by the actuating element. The cross shaped groove has end surfaces which form abutment surfaces for the corresponding surfaces of the projecting member.

9 Claims, 4 Drawing Sheets

ROOF SWITCH ASSEMBLY

CROSS-REFERENCE TO RELATED APPLICATION

This application claims the benefit under 35 U.S.C. §371 of published PCT Patent Application Number PCT/EP 2010/057686, filed Jun. 2, 2010, and published as WO2010/149475A1 on Dec. 29, 2011, the entire disclosure of which is hereby incorporated herein by reference.

TECHNICAL FIELD OF INVENTION

The present invention relates to electrical switch assemblies for sliding-rising-roofs of a motor vehicle remotely actuated by an auxiliary force, by means of which the adjusting drives of the roof for the sliding roof function can be activated by oppositely directed sliding movements of a control element and by means of which the adjusting drives for the rising roof function can be activated by oppositely directed pivot movements of the control element.

BACKGROUND OF INVENTION

Switch assemblies of the aforementioned type interrupt and complete electrical circuits by moving electrical switching contacts disposed in the housing of the switch assembly to contact fixed electrical switching contacts. It is thus possible for a user to apply an auxiliary force to an actuating element to switch on and off functions associated with different electrical circuits. Often such switch assemblies switch on and off the sliding and rising roof functions of a sliding-rising-roof of a motor vehicle. This type of switch assembly can be called lift-and-slide switch.

DE 39 31 722 C2 discloses a switch assembly having a housing which receives movable electrical switching contacts. The housing has a transverse axis and a longitudinal axis. An actuating element is mounted on the housing. Each of two axle journals associated with the actuating element engage a longitudinally elongated hole provided in opposite walls of the housing in parallel with the longitudinal axis. The two axle journals are rotatable and longitudinally displaceable within the elongated holes such that the actuating element is pivotable about the transverse axis and longitudinally movable along the longitudinal axis to move between switching positions.

The actuating element includes two guide cams each spaced apart from an axle journal in parallel with the longitudinal axis. The guide cams each engage a cross-shaped connecting member provided on the opposite walls of the housing to enable the actuating element to be pivotable and longitudinally movable. The actuating element can therefore be moved to switching positions by sliding and pivoting movements which correspond to the movements of a sliding-rising-roof of a motor vehicle.

The actuating element includes switching pieces which transmit the actuating element movements to the movable switching contacts to complete electrical circuits and enable switching functions associated with the switching positions. Furthermore, the switch assembly includes a plurality of compression spring-loaded control devices which ensure that the actuating element remains in a starting position and automatically returns from a switching position to the starting position. A problem associated with the switch assembly disclosed in DE 39 31 722 C2 is that the switch assembly includes a considerable number of individual parts which are complicated to assemble resulting in considerable assembly costs.

DE 34 15 997 C2 discloses a switch assembly wherein movements of the actuating element correspond to the movements of a sliding-rising-roof of a motor vehicle. The actuating element also includes two axle journals which are rotatable and longitudinally movable within elongated holes provided in opposite walls of the housing. The actuating element further includes two guide cams which pivotable and longitudinally displaceable engage a respective cross-shaped connecting member of the housing.

EP0778980 and U.S. Pat. No. 6,046,414 disclose other examples of this type of switch assembly.

All the existing solutions, with the functionality of crossing switch travel, have the drawback of snagging. The switch travel direction cannot be defined precisely such that the actuating element tends to hang loose generating bad feeling for the user. This problem is difficult to solve taking into account the dimensional tolerances of the different parts of the assembly.

SUMMARY OF THE INVENTION

Accordingly, it is an object of the present invention to provide a switch assembly for a sliding-rising-roof of a motor vehicle which maintains a high degree of functionality, which has a compact design, and which consists of exceptionally few individual parts which are convenient to assemble.

In carrying out the above object and other objects, features, and advantages, the present invention provides a switch assembly according to the preamble of claim 1, characterized in that each longitudinal wall comprises a cross-shaped groove including a cross-shaped guiding track, said cross shaped groove being dimensioned so as to receive a projecting member of the actuating element and said guiding track receiving a pressure piece carried by the actuating element and biased towards the bottom of said guiding track in order to guide the actuating element when it pivots and when it slides, and in that said cross shaped groove has end surfaces which form abutment surfaces for the corresponding surfaces of the projecting member in order to stop the actuating element in its extreme sliding and pivoting positions.

Thanks to the present invention, the guiding function and the stopping function in connection with the four different switching positions are obtained simply with a few components. It is economic and easy to manufacture. The haptic feeling for the user is also improved because there is no loosening and no snagging when the actuating element is manipulated. The switch assembly is more reliable and more robust because the stop positions are better defined.

According to other advantageous features of the present invention:

said switch assembly further comprises a first switching piece coupled to the actuating element to pivot as the actuating element pivots, said first pair of movable electrical switching contacts being associated with the first switching piece, wherein the first switching piece moves one of the first pair of switching contacts when the actuating element pivots to the third switching position and moves the other one of the first pair of switching contacts when the actuating element pivots to the fourth switching position, and a second switching piece coupled to the actuating element to pivot as the actuating element longitudinally moves, said second pair of movable electrical switching contacts being associated with the second switching piece, wherein the second switching piece moves one of the second pair of switching contacts when the actuating element longitudinally moves to the first switching position and moves the other one of the second pair of switching contacts when the actuating element pivots to the second switching position;

said guiding track extends in the bottom of the cross-shaped groove and said pressure piece extends transversally;

said pressure piece comprises a spring-loaded pressure sleeve forming a plunger having an hemispherical end, and said hemispherical end comes into sliding contact with two points on the parallel edges of the guiding track when the actuating element pivots and when it slides;

said guiding track has a central junction corresponding to the rest position of the actuating element;

said pressure piece is at least partly received in the projecting member;

said projecting member is made of one piece with the actuating element;

said first pair of switching contacts and said second pair of switching contacts are made of rubber dome switches which provide the detent force for the return motion of the actuating element towards its rest position;

each rubber dome comprises a linear actuator which is slidably mounted in the housing along a vertical axis in order to convert the pivoting movement of the corresponding switching piece into a linear movement generating a vertical depression force against said rubber dome.

BRIEF DESCRIPTION OF DRAWINGS

The present invention is now described by way of example with reference to the accompanying drawings in which.

DETAILED DESCRIPTION

Figure 1:
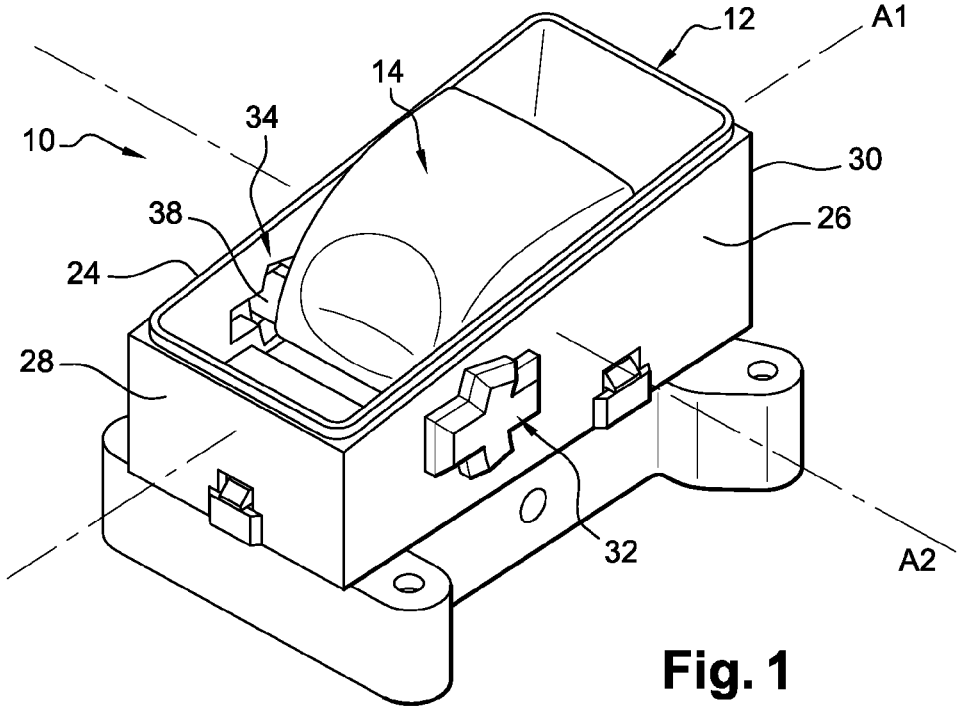
FIG. 1 is a perspective view showing a switch assembly according to the teaching of the present invention comprising a pivoting and sliding actuating element which is in its rest position.

In the following description, similar elements could be designated with the same reference numbers.

Referring now to FIGS. 1 to 7, a switch assembly 10 according to the present invention is shown. The switch assembly 10 includes a housing 12 and an actuating element 14 or button which is mounted on the housing 12. The actuating element 14 is movable between switching positions. The switch assembly 10 further includes movable electrical switching contacts 16, 18, 20, 22 disposed in the housing 12. A movement of the actuating element 14 causes the switching contacts 16, 18, 20, 22 to move between switching positions in relation to fixedly held switching contacts (not shown) disposed on a printed circuit board (not shown) to complete electrical circuits and enable switching functions associated with the switching positions.

The housing 12 has a pair of spaced apart longitudinal walls 24, 26 and a pair of spaced apart transverse walls 28, 30 delimiting a rectangular box receiving the actuating element 14.

Figure 2:
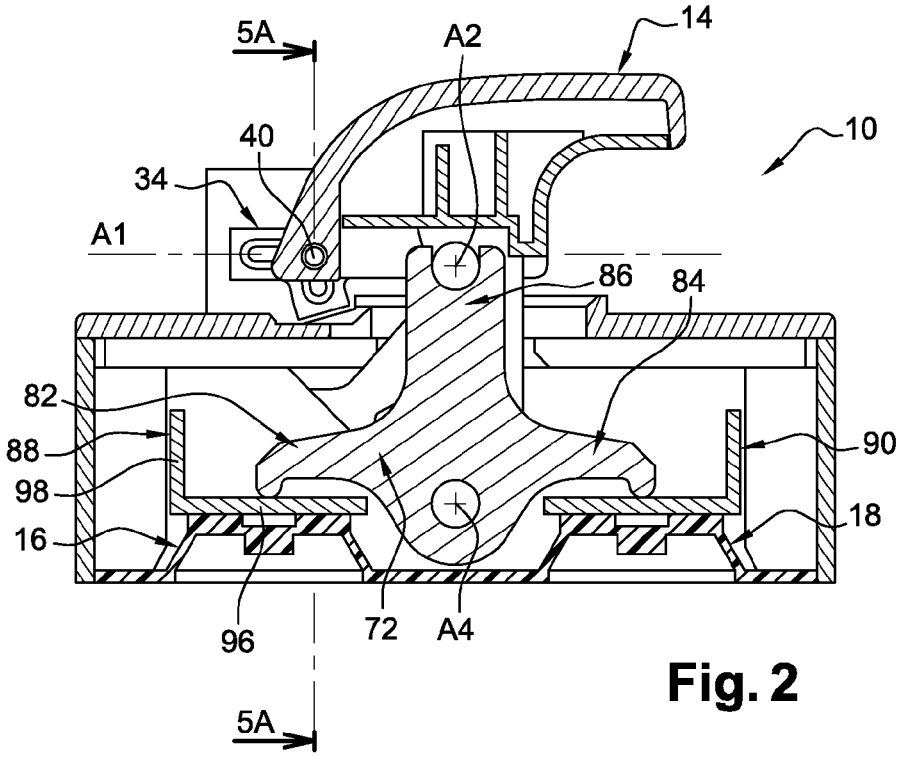
FIG. 2 is a cross-section view along line 2-2 of FIG. 4 showing a second switching piece for actuating a second pair of switching contacts, the actuating element being its rest position.
Figure 3:
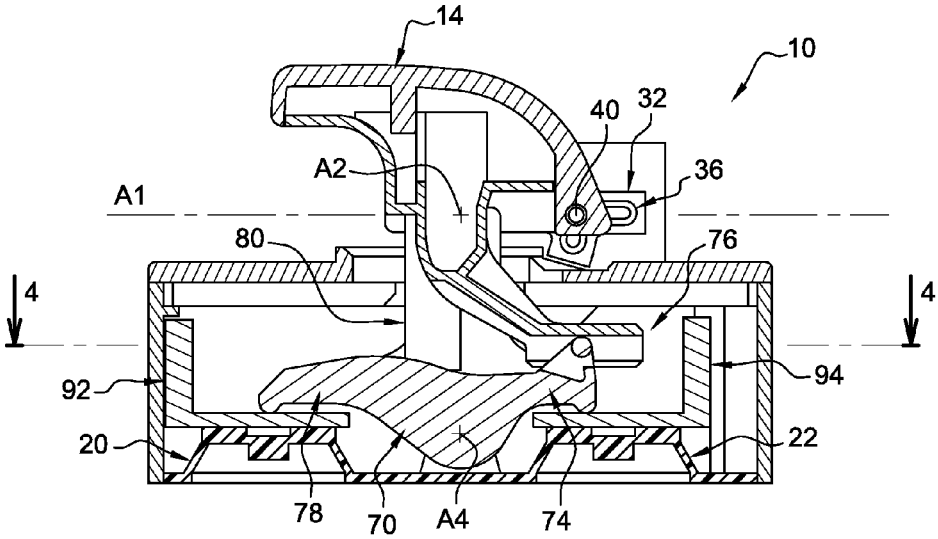
FIG. 3 is a cross-section view along line 3-3 of FIG. 4 showing a first switching piece for actuating a first pair of switching contacts, the actuating element being its rest position.
Figure 4:
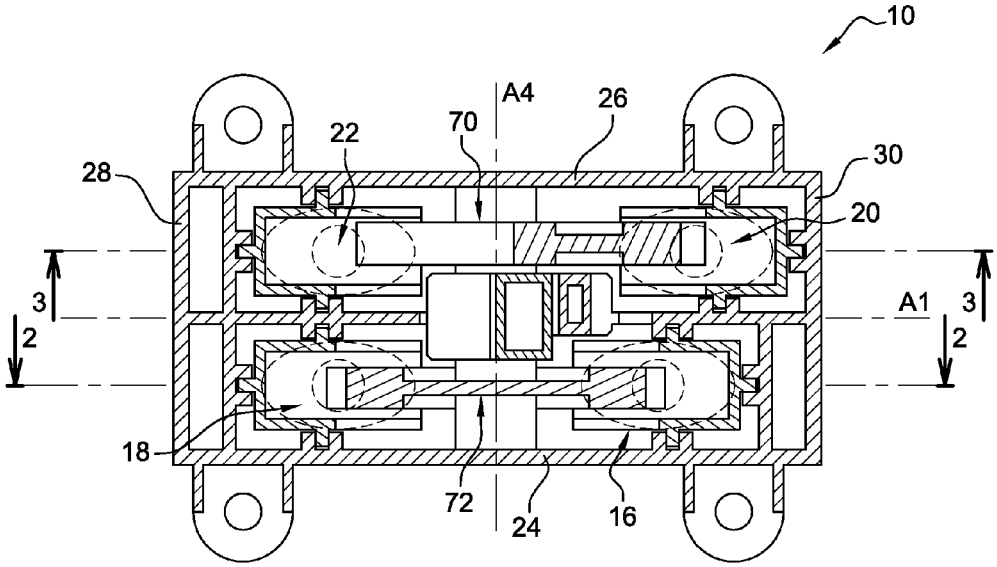
FIG. 4 is a cross-section view along line 4-4 of FIG. 3 showing the switching contacts and the switching pieces of FIGS. 2 and 3.

As is particularly evident in FIGS. 2 and 3, the actuating element 14 is longitudinally displaceable along a longitudinal axis A1 of the housing 12 between a first and second switching positions, here called forward and rear positions, and is pivotable about a transverse axis A2 of the housing 12, the transverse axis A2 extending perpendicularly to the longitudinal axis A1, between a third and fourth switching positions, here called upper and lower positions.

Figure 5A:
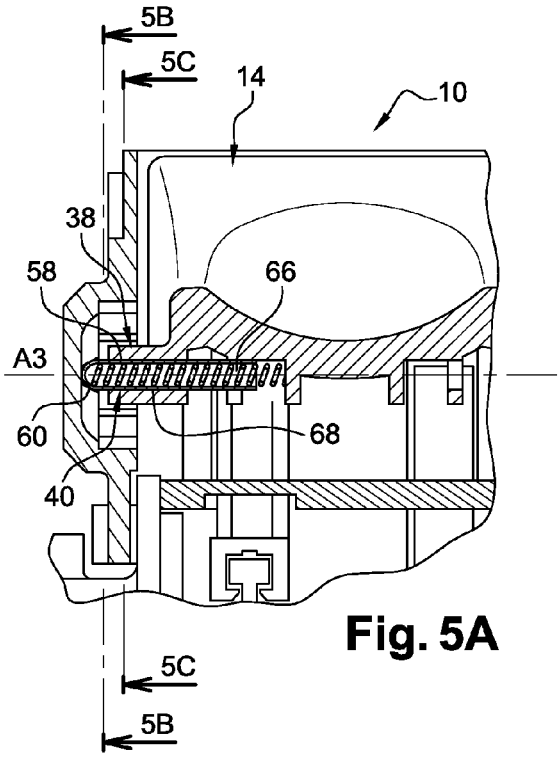
FIG. 5A is a partial cross-section view along line 5A-5A of FIG. 2 showing the guiding track, the pressure piece, and the cross-shaped groove of the actuating element when it is in its rest position.
Figure 5B:
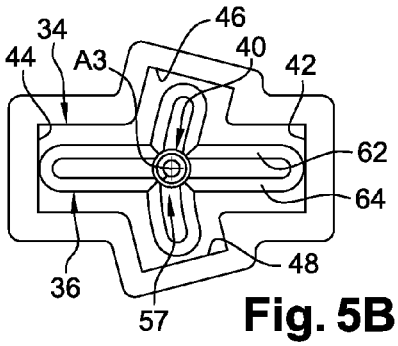
FIG. 5B is a partial cross-section view along line 5B-5B of FIG. 5A showing the guiding track and the pressure piece of the guiding means when the actuating element is in its rest position.

According to the teaching of the present invention, each longitudinal wall 24, 26 comprises a cross-shaped groove 32, 34 including a cross-shaped guiding track 36, as can be seen on the detailed views of FIGS. 5 to 7. Said guiding track 36 receives a pressure piece 40 carried by the actuating element 14 along a transverse axis A3 and biased towards the bottom of said guiding track 36 in order to guide the actuating element 14 when the latter pivots and when the latter slides.

Figure 5C:
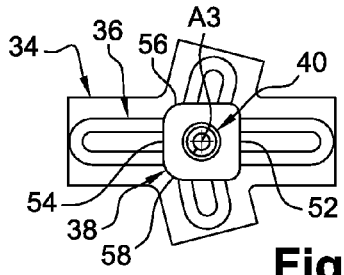
FIG. 5C is a partial cross-section view along line 5C-5C of FIG. 5A showing the cross-shaped groove and the projecting member of the actuating element when it is in its rest position.
Figure 6A:
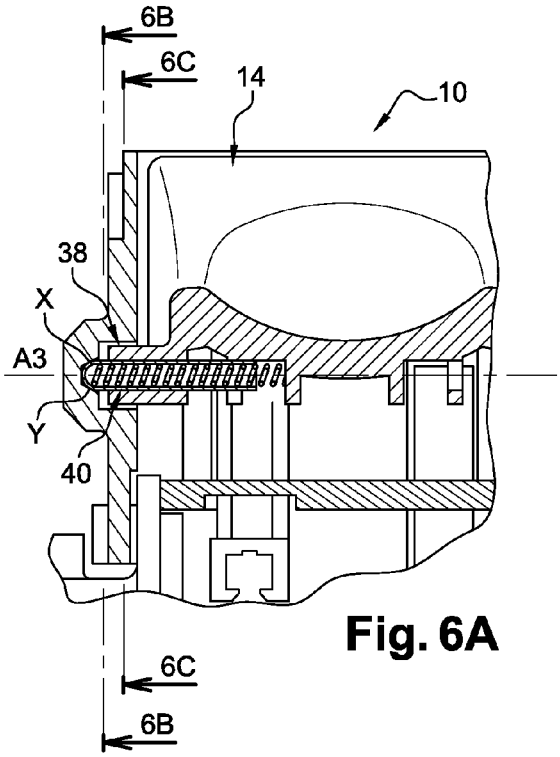
FIG. 6A, 6B, 6C are similar views to those of FIGS. 5A, 5B, 5C but show the actuating element in its front switching position.
Figure 6B:
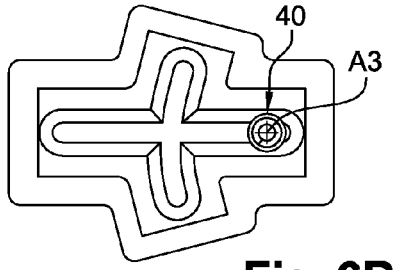
Figure 6C:
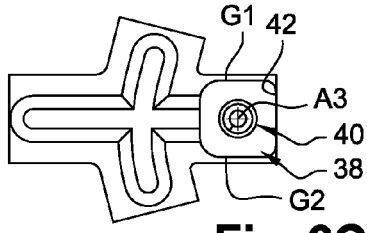
Figure 7A:
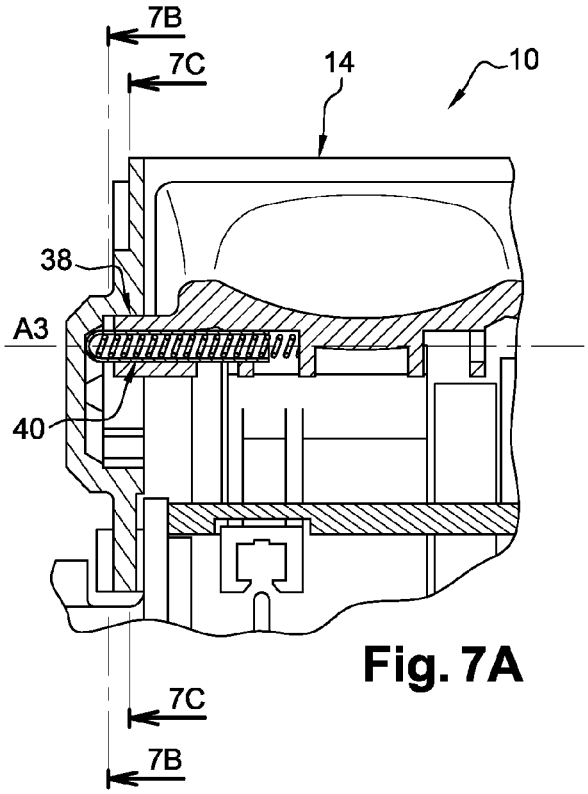
FIG. 7A, 7B, 7C are similar views to those of FIGS. 5A, 5B, 5C but show the actuating element in its upper switching position.
Figure 7B:
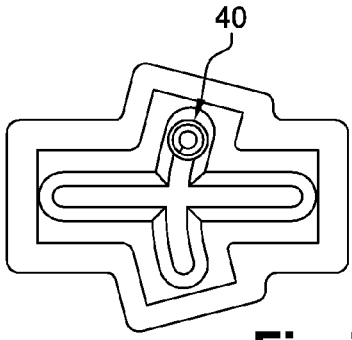
Figure 7C:
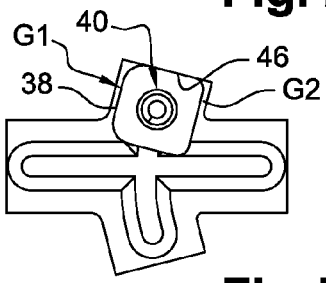

Said cross shaped groove 32, 34 is dimensioned so as to receive a projecting member 38 of the actuating element 14, which is best shown in cross section on FIGS. 5C, 6C, 7C. Said cross shaped groove 32, 34 has end surfaces 42, 44, 46 48 which form abutment surfaces for the corresponding surfaces of the projecting member 38 in order to stop the actuating element 14 in its extreme sliding and pivoting positions corresponding essentially to the switching positions. FIGS. 6A and 6C show the projecting member 38 in abutment against the end surface 42 when the actuating element 14 is in its front position and FIGS. 7A and 7C show the projecting member 38 in abutment against the end surface 46 when the actuating element 14 is in its upper position.

Advantageously, said projecting member 38 is made of one piece with the actuating element 14, for example by injection-molding. According to the present embodiment, said projecting member 38 has a substantially square profile in cross section along a longitudinal cutting plane so as to form four plane surfaces 50, 52, 54, 56 which are able to come into abutment against the corresponding end surfaces 42, 44, 46, 48 of the cross-shaped groove 32, 34.

Each cross-shaped groove 32, 34 is preferably made of plastic material by molding with the housing 12. Here it is made as a bumped out in the internal face of the longitudinal walls 24, 26. Said cross-shaped grooves 32, 34 do not open on the external faces of the longitudinal walls 24, 26.

As can be noted on FIGS. 6C and 7C, the width of each projecting member 38 is inferior to the width of each branch of the cross-shaped groove 32, 34 which forms a gap G1, G2 on each side of the projecting member 38. The guiding of the actuating element 14 during the motion is not implemented by the projecting member 38 but by the pressure piece 40 which cooperates with the guiding track 36.

Each guiding track 36 extends in the bottom of the cross-shaped groove 32, 34. It has as many branches as the cross-shaped groove 32, 34. As can be seen on FIGS. 6B and 7B, the guiding track 36 is dimensioned so as the projecting member 38 comes into abutment against the end surfaces 42, 44, 46, 48 before the pressure piece 40 reaches the end of the corresponding branch of the guiding track 36. At the central part of the cross formed by said guiding track 36, there is a central junction 57 which corresponds to the rest position of the actuating element 14.

According to the present embodiment, each pressure piece 40 comprises a spring-loaded pressure sleeve 58 forming a plunger having a hemispherical end 60 which comes into sliding contact with two points X, Y (FIG. 6A) on the parallel edges, or sloped walls 62, 64, of the guiding track 36 when the actuating element 14 pivots and when it slides. Each pressure piece 40 comprises a helical compression spring 66 which biases the sleeve 58 transversally against the guiding track 36. Of course a unique helical spring 66 could be used for the two pressure pieces 40 and arranged in an intermediate location between the two sleeves 58.

Advantageously, each pressure piece 40 is at least partly received in the corresponding projecting member 38. In the present embodiment, each sleeve 58 is received transversally into a cylinder bore 68 provided in each projecting member 38.

The switch assembly 10 also comprises a first switching piece 70 coupled to the actuating element 14 to pivot as the actuating element 14 pivots and a second switching piece 72 coupled to the actuating element 14 to pivot as the actuating element longitudinally moves. The switching pieces 70, 72 are arranged side by side along the longitudinal axis A1 in the housing 12.

A first pair of movable electrical switching contacts 20, 22 is associated with the first switching piece 70. Said first switching piece 70 moves the front one of the first pair of switching contacts 20, 22 when the actuating element 14 pivots to the upper switching position and moves the rear one 22 when the actuating element 14 pivots to the lower switching position.

A second pair of movable electrical switching contacts 16, 18 is associated with the second switching piece 72. Said second switching piece 72 moves the front one 18 of the second pair of switching contacts 16, 18 when the actuating element 14 longitudinally moves to the front switching position and moves the rear one 16 when the actuating element 14 pivots to the rear switching position.

Each switching piece 70, 72 comprises a lever which is pivotally mounted along a transverse axis A4 on the housing 12. Said first switching piece 70 comprises a first lever having a rear arm 74 which is actionable by an actuating arm 76 rigidly coupled to the actuating element 14 and a front arm 78 which is actionable by an actuating rod 80 rigidly coupled to the actuating element 14. The pivoting movement of the actuating element 14 is directly converted by a pivoting movement of the first switching piece 70. Said second switching piece 72 comprises a second lever having a rear arm 82 and a front arm 84 which are actionable by the sliding motion of the actuating element 14. The second lever has a fork-shaped upper projecting member 86 which is articulated on the transverse axis A2 of the actuating element 14. Thus, when the actuating element 14 is sliding longitudinally, its transverse axis A2 is moving longitudinally which generates a pivoting movement of the second lever along its transverse axis A4.

Preferably, said first pair of switching contacts 20, 22 and said second pair of switching contacts 16, 18 are constituted of rubber dome switches which provide the detent force for the return motion of the actuating element 14 towards its rest position. The use of rubber dome switches in connection with the guiding means provided by the invention is particularly advantageous because it prevents to use an auxiliary system to assist in moving the actuating element 14 towards its rest position.

According to the present embodiment, each switching contact 16, 18, 20, 22 comprises a linear actuator 88, 90, 92, 94 which is slidably mounted in the housing 12 along a vertical axis in order to convert the pivoting movement of the corresponding switching piece 70, 72 into a linear movement generating a vertical depression force against said rubber dome. Each linear actuator 88, 90, 92, 94 comprises a sliding horizontal plate 96, substantially parallel to the upper face of the rubber dome, and guiding walls 98 received in corresponding slots of the housing 12.

The invention claimed is:

1. A switch assembly for a lift-and-slide roof of a vehicle, said assembly comprising:

a housing having a longitudinal axis and a transverse axis, the housing having a pair of spaced apart longitudinal walls;

an actuating element mounted to the housing, wherein the actuating element is longitudinally movable along the longitudinal axis between a first switching position and second switching position and is pivotable about the transverse axis between a third switching position and fourth switching position;

a first pair of movable electrical switching contacts, wherein one of the first pair of switching contacts is moved to enable a switching function associated with the third switching position when the actuating element pivots to the third switching position and the other one of the first pair of switching contacts is moved to enable a switching function associated with the fourth switching position when the actuating element pivots to the fourth switching position; and a second pair of movable electrical switching contacts, wherein one of the second pair of switching contacts is moved to enable a switching function associated with the first switching position when the actuating element longitudinally moves to the first switching position and the other one of the second pair of switching contacts is moved to enable a switching function associated with the second switching position when the actuating element pivots to the second switching position, wherein each longitudinal wall comprises a cross-shaped groove including a cross-shaped guiding track, said cross shaped groove being dimensioned so as to receive a projecting member of the actuating element and said guiding track receiving a pressure piece carried by the actuating element and biased towards the bottom of said guiding track in order to guide the actuating element when it pivots and when it slides, and in that said cross shaped groove has end surfaces which form abutment surfaces for the corresponding surfaces of the projecting member in order to stop the actuating element in its extreme sliding and pivoting positions.

2. The assembly according to claim 1, wherein said assembly further comprises a first switching piece coupled to the actuating element to pivot as the actuating element pivots, said first pair of movable electrical switching contacts being associated with the first switching piece, wherein the first switching piece moves one of the first pair of switching contacts when the actuating element pivots to the third switching position and moves the other one of the first pair of switching contacts when the actuating element pivots to the fourth switching position; and a second switching piece coupled to the actuating element to pivot as the actuating element longitudinally moves, said second pair of movable electrical switching contacts being associated with the second switching piece, wherein the second switching piece moves one of the second pair of switching contacts when the actuating element longitudinally moves to the first switching position and moves the other one of the second pair of switching contacts when the actuating element pivots to the second switching position.

3. The assembly according to claim 1, wherein said guiding track extends in the bottom of the cross-shaped groove and said pressure piece extends transversally.

4. The assembly according to claim 3, wherein said pressure piece comprises a spring-loaded pressure sleeve forming a plunger having an hemispherical end, and in that said hemispherical end comes into sliding contact with two points on the parallel edges of the guiding track when the actuating element pivots and when it slides.

5. The assembly according to claim 1, wherein said guiding track has a central junction corresponding to the rest position of the actuating element.

6. The assembly according to claim 1, wherein said pressure piece is at least partly received in the projecting member.

7. The assembly according to claim 1, wherein said projecting member is made of one piece with the actuating element.

8. The assembly according to claim 1, wherein said first pair of switching contacts and said second pair of switching contacts are constituted of rubber dome switches which provide the resilient force for the return motion of the actuating element towards its rest position.

9. The assembly according to claim 8, wherein said assembly further comprises a first switching piece coupled to the actuating element to pivot as the actuating element pivots, said first pair of movable electrical switching contacts being associated with the first switching piece, wherein the first switching piece moves one of the first pair of switching contacts when the actuating element pivots to the third switching position and moves the other one of the first pair of switching contacts when the actuating element pivots to the fourth switching position; and a second switching piece coupled to the actuating element to pivot as the actuating element longitudinally moves, said second pair of movable electrical switching contacts being associated with the second switching piece, wherein the second switching piece moves one of the second pair of switching contacts when the actuating element longitudinally moves to the first switching position and moves the other one of the second pair of switching contacts when the actuating element pivots to the second switching position, wherein each rubber dome comprises a linear actuator which is slidably mounted in the housing along a vertical axis in order to convert the pivoting movement of the corresponding switching piece into a linear movement generating a vertical depression force against said rubber dome.

* * * * *